United States Patent [19]

Romanowski

[11] 4,072,276

[45] Feb. 7, 1978

[54] PULVERIZER WITH CASTER ROLLER ASSEMBLY

[75] Inventor: Chester J. Romanowski, Carteret, N.J.

[73] Assignee: Foster Wheeler Energy Corporation, Livingston, N.J.

[21] Appl. No.: 785,394

[22] Filed: Apr. 7, 1977

[51] Int. Cl.[2] ..... B02C 15/04

[52] U.S. Cl. ..... 241/117; 241/118; 241/127

[58] Field of Search ..... 241/117, 118, 119, 120, 241/121, 122, 123, 127, 128, 132

[56] References Cited

U.S. PATENT DOCUMENTS

| | | | |
|---|---|---|---|
| Re. 25,552 | 4/1964 | Berz | 241/118 |
| 592,828 | 11/1897 | Reynolds | 241/127 |
| 3,061,208 | 10/1962 | Schauer et al. | 241/117 |
| 3,083,920 | 4/1963 | Schauer | 241/117 |
| 3,782,646 | 1/1974 | Brundiek | 241/117 |

*Primary Examiner*—Granville Y. Custer, Jr.
*Attorney, Agent, or Firm*—Marvin A. Naigur; John E. Wilson

[57] ABSTRACT

An apparatus is provided for pulverizing material into comminuted particles in which at least three rollers are mounted for rotation and maintained in contact with the material on a grinding ring. The rollers are suspended in a manner to allow the rollers to swivel about respective vertical axes perpendicular to their respective axes of rotation.

8 Claims, 6 Drawing Figures

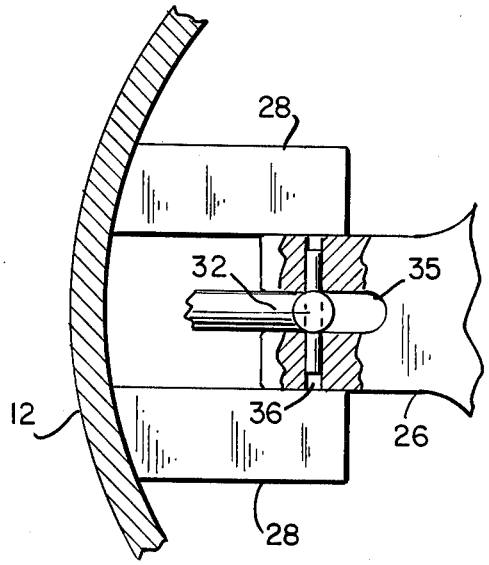
FIG. 2
FIG. 6
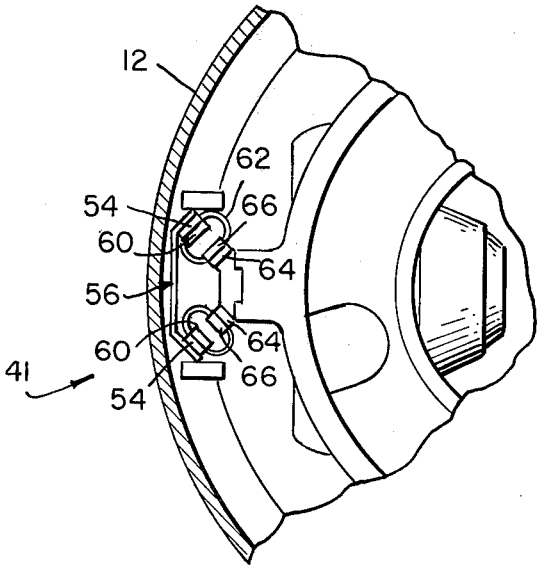
FIG. 4
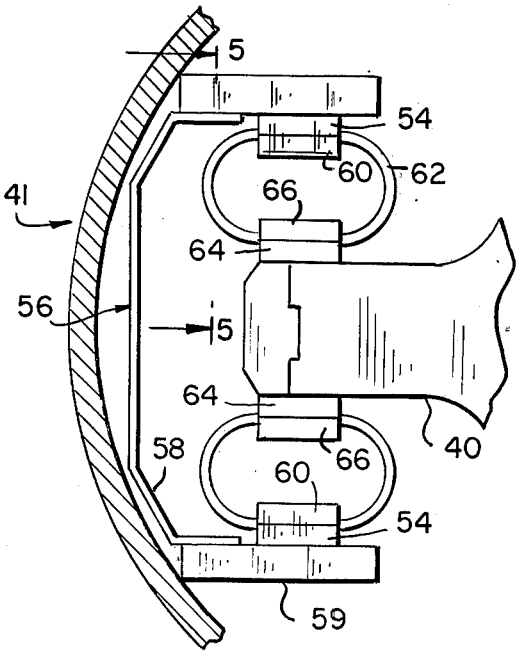

PULVERIZER WITH CASTER ROLLER ASSEMBLY

BACKGROUND OF THE INVENTION

In connection with the operation of coal-fired furnaces which are used in vapor generating systems in the utility industries for the production of electricity, it is necessary to supply finely powdered coal to the combustion chamber of the furnace. The raw coal feedstock is usually reduced to comminuted particles in a pulverizing apparatus which generally consists of a housing in which is located a rotating grinding table having a grinding ring, and in which relatively heavy rollers are journaled and maintained in contact with the material on the grinding ring.

Various arrangements of pulverizing apparatuses have been used in the past. For example, there have been pulverizers consisting of a plurality of rollers over which a thrust ring was located which applied a downward load to the rollers which would travel in a planetary manner. In such a design the rollers would tend to skid at the point where the pressure ring contacted the roller. Additionally, the ring and rollers would wear as a result of the contact between them.

In another design the rollers were attached to an upper pressure transmitting ring which allowed for vertical movement of the rollers, but did not allow for lateral movement. Such a design subjected the rollers and upper ring to severe stress from vibration.

In a further known design the rollers were attached to an upper pressure transmitting ring which allowed for vertical as well as lateral movement of the rollers by mounting the roller axles on suspension members fulcrumed on the pressure transmitting ring. Such a design restricted the capability of the roller to move around any accumulation of material to be ground since only lateral or vertical movement was provided for.

SUMMARY OF THE INVENTION

In accordance with an illustrative embodiment demonstrating features and advantages of the present invention, there is provided an apparatus for pulverizing material into comminuted particles. A housing is provided in which a rotatable table is mounted. A grinding ring is mounted on the table, and defines a circumferential path on the table. Means are provided for rotating the table. Means are also provided for introducing material into the housing in contact with the grinding ring. At least three rollers are disposed in the housing. Means are provided for supporting the rollers for rotation about respective axes of rotation. Each supporting means includes a shaft which defines a swivel axis lying forward of the axis of rotation of its respective roller.

BRIEF DESCRIPTION OF THE DRAWINGS

The above brief description as well as further objects, features and advantages of the present invention will be more fully appreciated by reference to the following detailed description of the preferred embodiment in accordance with the present invention when taken in connection with the accompanying drawings wherein:

FIG. 2 is a plan view partially in section taken along line 2—2 of FIG. 1 illustrating upper spring ring projection and guides of the present invention;

FIG. 4 is a plan view of a part of the caster roller assembly shown in FIG. 1 showing one arrangement of a lower spring ring stabilizer assembly of the present invention;

FIG. 6 is a plan view similar to that of FIG. 4 with portions shown in section to illustrate an alternative arrangement of a lower spring ring stabilizer assembly of the present invention.

DESCRIPTION OF THE PREFERRED EMBODIMENT

Figure 1:
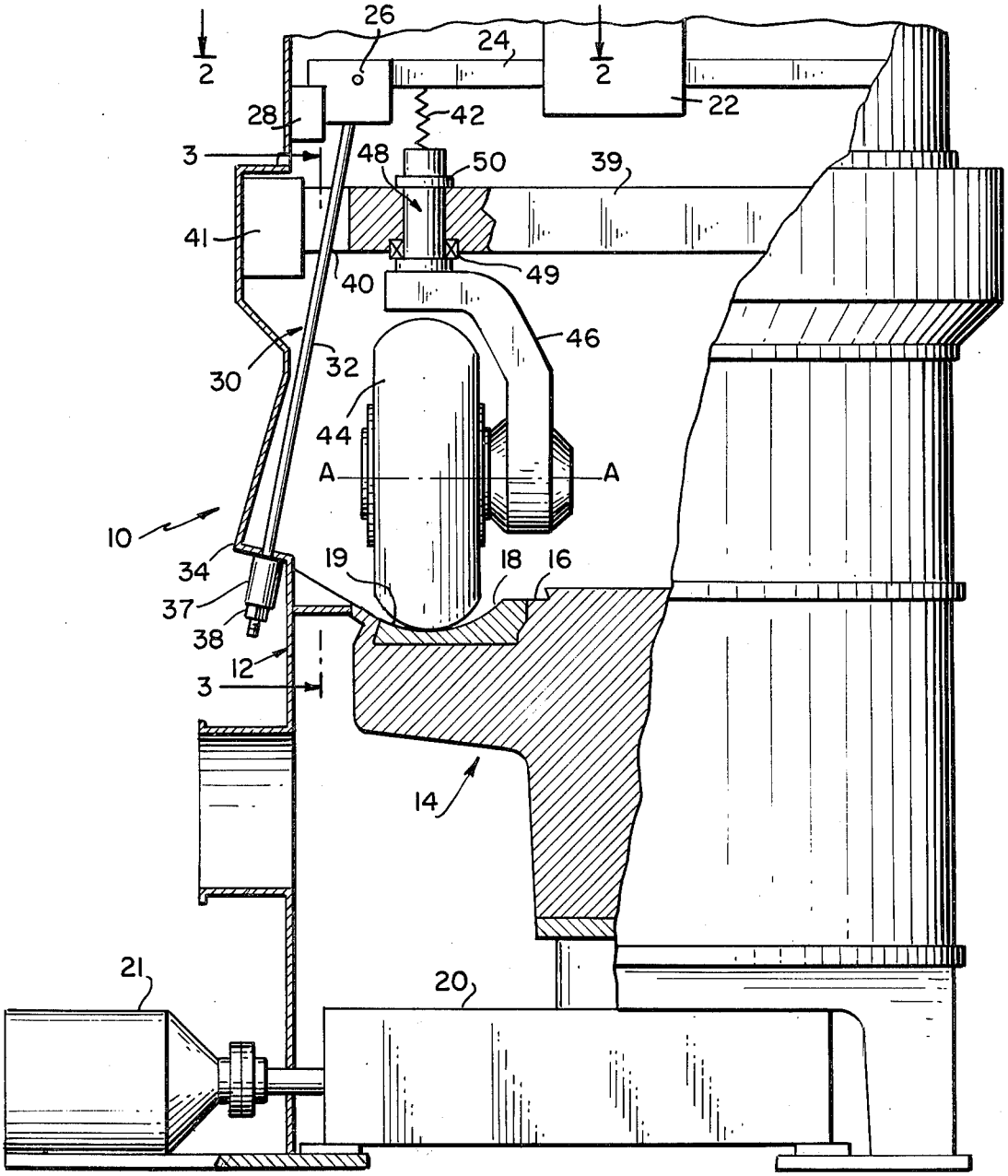
FIG. 1 is an elevational view of a pulverizing apparatus embodying features of the present invention with portions broken away and sectioned to show the location of a roller within the housing of the apparatus.

Referring to FIG. 1 of the drawings, there is shown a pulverizing apparatus which is generally designated by the reference numeral 10. The pulverizing apparatus 10 includes a housing 12 which is mounted at ground level and which defines an enclosure in which is mounted grinding unit 14. The grinding unit 14 includes a table 16 on which is mounted a removable grinding ring 18 formed with an annular groove 19. The table 16 is mounted for rotation on a speed reducer 20 and is powered by an electric motor 21. A conduit 22 is positioned above the grinding unit 14 and is used to introduce raw coal feedstock into the housing 12.

Within the housing an upper spring ring 24 is centrally disposed with projection 26 located between guides 28 which are mounted to the housing 12, which is more clearly shown in FIG. 2. While only one projection 26 is shown between guides 28, it is to be understood that at least three projections 26 are to be utilized which would be maintained within corresponding guides 28. In this manner, the rotation of upper spring ring 24 is restricted by the guides 28 which are fixed to the housing 12.

Referring again to FIG. 1, a spring loading assembly 30 is disposed in housing 12 and consists of tension member 32 extending upwardly through a shoulder 34 defined by housing 12 and is secured at its upper end to projection 26 of upper spring ring 24. As can be better seen in FIG. 2, the projection 26 of upper spring ring 24 is in the form of a clevis having a center slot 35 for receiving the upper end of tension member 32. A pin 36 extends into both ears of the clevis and through a hole in tension member 32, thereby securing tension member 32 to projection 26. It is to be understood that alternative tension members such as cables wrapped over projections 26 may be substituted for the particular tension member described. The lower end of tension member 32 extends through shoulder 34, then through tensioner 37 and is secured by fastener 38. Tensioner 37 is in the form of a hydraulic jack which when actuated will move tension member 32 upwardly or downwardly thereby varying the downward force applied to upper spring ring 24 by tension member 32. Fastener 38 may be in the form of a nut having threads formed therein for receiving a threaded lower end of tension member 32.

Below the upper spring ring 24 there is disposed a lower spring ring 39 having a projection 40 flexibly secured to the housing 12 by a stabilizer assembly 41 which will be described later. While only one projection 40 is shown, it is to be understood that at least three projections 40 are to be utilized with each projection 40 being flexibly secured to the housing 12 by a corresponding stabilizer assembly 41. Spring 42 is disposed between upper spring ring 24 and lower spring ring 39. In this manner, when tension member 32 is moved downwardly, a downward load is applied to upper spring ring 24 thereby compressing spring 42 which in turn urges lower spring ring 39 downwardly. While only one loading assembly 30 including tension member 32 and spring 42 are shown, it is to be understood that a plurality of each is to be utilized, A roller 44 is mounted on a bracket 46 for rotation about horizontal axis A—A. Bracket 46 is mounted at its upper end in an opening formed in lower spring ring 39. The upper end of bracket 46 comprises a vertical shaft 48 which is received in the opening in lower spring ring 39. A thrust bearing 49 is disposed between the lower ring opening and shaft 48. Shaft 48 is attached at its top to fastener 50. In this manner, roller 44 is suspended from lower spring ring 39, and when ring 39 is urged downwardly by the force transmitted through spring 42, bracket 46 transmits a downward force to roller 44 thereby urging roller 44 in contact with material to by pulverized on grinding ring 18.

Figure 3:
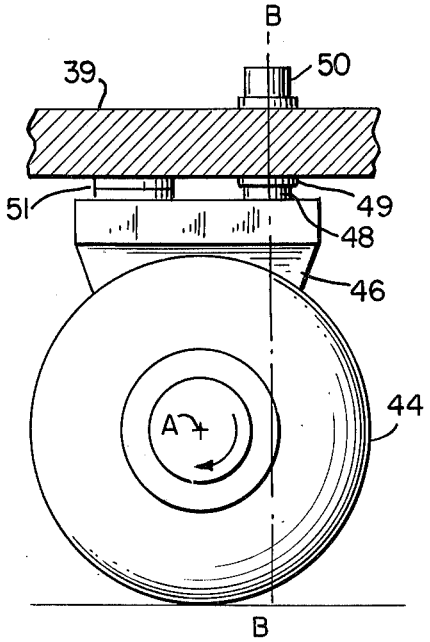
FIG. 3 is an elevational view taken along line 3—3 of FIG. 1 showing buffer pads of the instant invention and illustrating the direction of rotation of a roller relative to the support means.

Referring now to FIG. 3, it can be seen that the axis of shaft 48 defines a vertical axis B—B disposed forward of the axis of rotation A—A of the roller 44. It can be appreciated that by having the shaft 48 so disposed, the roller 44 is supported in a caster-like manner. Also shown are buffer pads 51 disposed between bracket 46 and lower spring ring 39. Buffer pads 51 are utilized to absorb energy transmitted through roller 44 and bracket 46 as a result of the bending moment created by the shock load exerted on roller 44 upon its contacting hard particles in the material to be pulverized.

Figure 5:
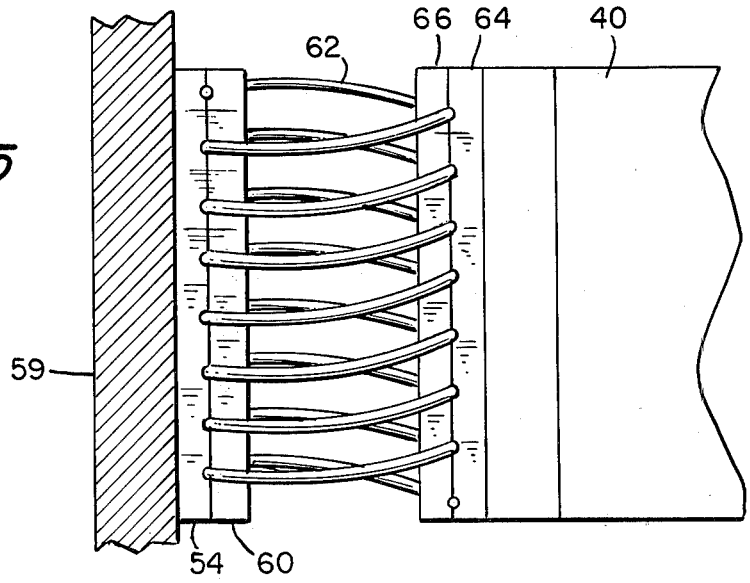
FIG. 5 is a sectional view of a lower spring ring stabilizer assembly of the present invention taken along line 5—5 of FIG. 4, showing the lower spring ring mounted to the housing.

In FIG. 4 there is shown a stabilizer assembly 41 which is provided to restrict the vertical and rotational movement of lower spring ring 39. Stabilizer assembly 41 consists of outer bars 54 rigidly secured to a bracket 56 which is in turn rigidly secured to housing 12. The bracket 56 includes a bent member 58 and straight members 59. Rigidly secured to outer bars 54, for example by means of bolts, are inner bars 60. Both bars 54 and 60 have grooves which are aligned and together define openings for receiving coils of spring 62. Additional outer bars 64 are disposed opposite bars 54 and are rigidly secured to inner bars 66. Bars 64 and 66 have grooves which are aligned and together define openings for receiving coils of the spring 62 generally opposite from bars 60 and 64. Outer bars 64 are rigidly secured to the lower spring ring projection 40. The alternate stabilizer arrangement shown in FIG. 6 is similar to that of FIGS. 4 and 5 and identical components are referred to by the same reference numerals. Further illustration of the stabilizer assembly is shown in FIG. 5, wherein the alignment of the grooves in bars 54 and 60 for the receipt of coils of spring 62 is depicted. Also shown is the arrangement of bar 64 which is rigidly secured to projection 40 of lower spring ring 39.

While only one roller and stabilizer assembly have been illustrated, it is to be understood that at least three rollers and stabilizers are to be utilized. In operation raw coal feedstock is introduced through conduit 22 into the housing 12 and falls to the grinding ring 18, which is rotated by virtue of the electric motor rotating table 16. Spring loading assembly 30 applies a downward force to the upper spring ring 24 which transmits a downward force to spring 42 which in turn forces downward on the lower spring ring 39. Lower spring ring 39 thereafter transmits a downward force through bracket 46 to roller 44 thereby forcing roller 44 to come in contact with the raw coal feedstock on grinding ring 18. Stabilizer assembly 41 operates to restrict the vertical and rotational movement of lower spring ring 39 after the downward force has been applied to ring 39. Upon coming in contact with the raw coal feedstock, the friction force created by the rotation of table 16 will cause roller 44 to rotate about its axis A—A. Since roller 44 is pivotably suspended from lower spring ring 39, it is free to swivel about the axis B—B upon coming in contact with hard material and can move around hard material. Additionally, because lower spring ring 39 is allowed to travel vertically, roller 44 can move upwardly and proceed over hard particles. In the event that a shock load is applied to bracket 46 upon roller 44 coming in contact with hard material, buffer pads 51 absorb the energy transmitted as a result of the bending moment created by the shock load. Since axis B—B is forward of the axis of rotation A—A of the roller 44, the roller 44 travels in a caster-like manner which allows for better tracking of the roller in groove 19 of the grinding ring 18. Because of this caster-like movement, roller 44 will return to its normal position after proceeding around hard material.

A latitude of modification, change, and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. Apparatus for pulverizing material including hard material into comminuted particles comprising a housing, a rotatable table mounted within said housing, a grinding ring mounted on said table and defining a circumferential path on said table, means for rotating said table, means for introducing said material into said housing in contact with said grinding ring, at least three rollers disposed in said housing, means for mounting said rollers in said housing for rotation about respective axes of rotation, said mounting means including a supporting ring disposed above said roller, a plurality of brackets, each of said rollers being mounted on a respective one of said brackets, and a plurality of shafts, each one of said shafts being connected between said ring and a respective one of said brackets and defining a swivel axis lying forward of the axis of rotation of its respective roller, and means for absorbing a shock load applied to said roller disposed between said brackets and said mounting ring and adapted to allow said rollers to move about said respective swivel axes.

2. Apparatus for pulverizing material according to claim 1 wherein said means for absorbing said shock load comprises a pad attached to the underside of said supporting ring.

3. Apparatus for pulverizing material according to claim 1 wherein said means for absorbing said shock lead comprises pads attached to the tops of said brackets.

4. Apparatus for pulverizing material according to claim 1 in which said means for absorbing said shock load comprises a pad attached to the underside of said supporting ring, and pads attached to the tops of said brackets.

5. Apparatus for pulverizing material according to claim 1 further including an upper spring ring centrally disposed within said housing and positioned above said supporting ring, a plurality of springs disposed between said upper spring ring and said supporting ring, and means for applying a downward load to said upper spring ring.

6. Apparatus for pulverizing material according to claim 1 in which said axes of rotation are horizontal and said swivel axes are vertical.

7. Apparatus for pulverizing material according to claim 6 in which means are provided for restricting the vertical and horizontal movement of said lower spring ring.

8. Apparatus for pulverizing material according to claim 7 in which means are provided for restricting the rotational movement of said upper spring ring.

* * * * *